US010097932B2

(12) United States Patent
Nikles et al.

(10) Patent No.: US 10,097,932 B2
(45) Date of Patent: Oct. 9, 2018

(54) LOUDSPEAKER MODULE FOR A HEARING DEVICE, AND HEARING DEVICE

(71) Applicant: SIVANTOS PTE. LTD., Singapore (SG)

(72) Inventors: Peter Nikles, Erlangen (DE); Juergen Reithinger, Neunkirchen am Brand (DE)

(73) Assignee: Sivantos Pte. Ltd., Singapore (SG)

( * ) Notice: Subject to any disclaimer, the term of this patent is extended or adjusted under 35 U.S.C. 154(b) by 0 days.

(21) Appl. No.: 15/427,187

(22) Filed: Feb. 8, 2017

(65) Prior Publication Data

US 2017/0245066 A1 Aug. 24, 2017

(30) Foreign Application Priority Data

Feb. 22, 2016 (DE) ..... 10 2016 202 658

(51) Int. Cl.

| | |
|---|---|
| ***H04R 25/00*** | (2006.01) |
| ***H01Q 7/08*** | (2006.01) |
| ***H01Q 1/24*** | (2006.01) |
| ***H01Q 1/27*** | (2006.01) |
| ***H01Q 1/44*** | (2006.01) |

(Continued)

(52) U.S. Cl.

CPC ..... *H04R 25/554* (2013.01); *H01Q 1/24* (2013.01); *H01Q 1/273* (2013.01); *H01Q 1/44* (2013.01); *H01Q 7/08* (2013.01); *H04R 1/1075* (2013.01); *H04R 11/02* (2013.01); *H04R 25/60* (2013.01); *H04R 25/65* (2013.01); *H04R 2225/025* (2013.01); *H04R 2225/51* (2013.01)

(58) Field of Classification Search

CPC ..... H04R 1/1075; H04R 11/02; H04R 25/55; H04R 25/554; H04R 25/60; H04R 25/65; H04R 25/658; H04R 2225/025; H04R 2225/51; H04R 2225/55; H01Q 1/273

USPC ..... 381/312, 315, 322, 324, 328, 331, 189; 379/52, 443; 343/718, 788

See application file for complete search history.

(56) References Cited

U.S. PATENT DOCUMENTS

| | | | | |
|---|---|---|---|---|
| 7,190,803 | B2 * | 3/2007 | van Halteren ..... | H04R 11/02 381/398 |
| 7,260,234 | B2 | 8/2007 | Kasztelan et al. | |
| 9,253,582 | B2 | 2/2016 | Nikles et al. | |

(Continued)

FOREIGN PATENT DOCUMENTS

| | | | |
|---|---|---|---|
| DE | 102006043909 | B3 | 4/2008 |
| DE | 102013210689 | B3 | 10/2014 |

(Continued)

*Primary Examiner* — Huyen D Le

(74) *Attorney, Agent, or Firm* — Laurence A. Greenberg; Werner H. Stemer; Ralph E. Locher

(57) ABSTRACT

A loudspeaker module for a hearing device has a loudspeaker, which has a loudspeaker diaphragm and a drive for the loudspeaker diaphragm, and a housing, in which the loudspeaker is arranged. Furthermore, the loudspeaker module contains an antenna unit, which has an antenna coil having a coil axis, a tubular coil core, which forms a sound channel, and an antenna base plate, in which a sound passage opening that opens into the sound channel is formed. The antenna coil, the coil core and the antenna base plate in this case prescribe an antenna characteristic of the antenna unit. The side wall of the housing on the diaphragm side is in this case formed by the antenna base plate.

9 Claims, 4 Drawing Sheets

(51) Int. Cl.
*H04R 1/10* (2006.01)
*H04R 11/02* (2006.01)

(56) References Cited

U.S. PATENT DOCUMENTS

| | | | | |
|---|---|---|---|---|
| 9,521,494 | B2 | 12/2016 | Nikles | |
| 2008/0226108 | A1 | 9/2008 | Heerlein et al. | |
| 2011/0038503 | A1* | 2/2011 | Yang | H04R 1/22 381/380 |
| 2014/0169583 | A1* | 6/2014 | Huang | H04R 1/24 381/74 |
| 2015/0201290 | A1* | 7/2015 | Nikles | H04R 25/65 381/315 |
| 2016/0157027 | A1* | 6/2016 | Hug | H04R 25/48 381/351 |

FOREIGN PATENT DOCUMENTS

| | | | |
|---|---|---|---|
| DE | 102014200524 | A1 | 7/2015 |
| EP | 1389891 | A2 | 2/2004 |
| EP | 2894880 | A2 | 7/2015 |
| WO | 2004064483 | A2 | 8/2004 |
| WO | 2013135307 | A1 | 9/2013 |

* cited by examiner

LOUDSPEAKER MODULE FOR A HEARING DEVICE, AND HEARING DEVICE

CROSS-REFERENCE TO RELATED APPLICATION

This application claims the priority, under 35 U.S.C. § 119, of German application DE 10 2016 202 658.5, filed Feb. 22, 2016; the prior application is herewith incorporated by reference in its entirety.

BACKGROUND OF THE INVENTION

Field of the Invention

The invention relates to a loudspeaker module for a hearing device. Furthermore, the invention relates to a hearing device having such a loudspeaker module.

The term "hearing device" covers particularly hearing aids, which are used by people with a hearing impairment to at least partially compensate for this hearing impairment. To this end, hearing aids usually contain, as components, at least one microphone for picking up audible sound signals (e.g. voices, music and/or other ambient sounds), a signal processing unit (also referred to as signal processor) for filtering and at least partially amplifying the sound signals picked up and a loudspeaker (in most cases also referred to as "receiver") for outputting the processed sound signals to an ear of a hearing device wearer (i.e. the person with hearing impairment). As an alternative to the loudspeaker, hearing aids comprise—depending on the type of hearing impairment—by way of example a bone conduction implant or cochlear implant for mechanically or electrically stimulating the hearing center of the hearing device wearer. However, the term "hearing device" also covers other devices that are used for outputting (audible) sound signals to the ear of the relevant hearing device wearer. Devices of this kind are what are known as tinnitus maskers, headphones, headsets and the like, for example.

A hearing device, particularly a hearing aid, may be in the form of a single "monaural" hearing aid for independently supplying to an ear of the hearing device wearer, for example. A monaural hearing device or hearing aid of this kind usually has all the components described above integrated in it in this case. The hearing device or hearing aid may, however, also be part of a binaural hearing device system. A binaural hearing device system of this kind is in this case regularly set up to supply to both ears of the hearing device wearer. In this case, a data interchange (signal interchange) allowing the actual binaural signal processing usually takes place between the two (binaural) hearing devices. As such, binaural hearing devices are frequently equipped with signal processing algorithms that are used to take into consideration the sound signals received by both hearing devices, for example for the purpose of producing a directional effect. This is recognized as requiring the sound signals to be transmitted between the hearing devices.

The data interchange between the two binaural hearing devices is effected regularly by a radio system in this case. That is to say that both binaural hearing devices have at least one antenna for sending and/or receiving the data to be interchanged. These antennas are an element in addition to the components described above, however, which is recognized as needing to be placed inside a hearing device housing (at least within the installation space available for the hearing device). In order to be able to maintain a sufficiently high quality for the sending and receiving of the data to be interchanged, a certain minimum size (particularly a certain minimum volume) of the antenna must be observed, however. The space requirement that is therefore needed for the antenna runs contrary to the efforts to provide hearing devices of all designs (e.g. behind-the-ear, in-the-ear or in-the-canal hearing devices) with ever smaller housing volumes, however. The reason is that other hearing device components, such as particularly the loudspeaker, cannot be reduced in size arbitrarily, since otherwise the sound quality and the efficiency of the output sound signals would decrease.

Sound quality is one of the main quality features that the hearing device wearer perceives when using a hearing device, however. The sound characteristic and the efficiency at low frequencies (and hence the subjectively perceived sound quality) of a loudspeaker is in this case influenced particularly by a back volume, which is usually formed by a volume that is demarcated from the surroundings by a loudspeaker diaphragm producing the sound signals, and by a front volume, which is arranged between the loudspeaker diaphragm and the sound outlet of the receiver or between the sound outlet of the receiver and the eardrum. In particular, the ratio of back volume and front volume in this case affects the sound quality and efficiency of the receiver. Usually, the term front volume relates in this case to the volume between the loudspeaker diaphragm and the sound outlet of the receiver. Standard loudspeakers used in a hearing device are in most cases arranged inside the hearing device housing and connected by means of a sound connecting piece or a sound tube, which forms a sound channel, to a sound output of the hearing device housing. The volume arranged between the loudspeaker diaphragm and the sound output is therefore accordingly the front volume in this context.

SUMMARY OF THE INVENTION

The invention is based on the object of allowing an improved sound characteristic for a hearing device that is set up for radio-based data transmission.

The loudspeaker module according to the invention is set up and provided for use in a hearing device having radio-based data transmission. The loudspeaker module in this case contains a loudspeaker that has a loudspeaker diaphragm and a drive for this loudspeaker diaphragm (subsequently: diaphragm drive). Furthermore, the loudspeaker module has a housing in which the loudspeaker is arranged. Preferably, the housing surrounds the loudspeaker in this case on all sides apart from an opening through which audible signals can emerge into the surroundings during operation of the loudspeaker. The loudspeaker module moreover contains an antenna unit for sending and/or receiving electromagnetic signals. This antenna unit in this case has an antenna coil, having a coil axis, and a tubular coil core onto which the antenna coil is wound and that forms a sound channel. The term "tubular" is in this case intended to be understood without restriction to a specific cross sectional shape of the tube. As such, the tubularly extending coil core has particularly a square, rectangular, polygonal, oval or round cross section. In one possible embodiment, the cross sectional shape varies along the coil core. The antenna coil in this case extends preferably rectilinearly along its coil axis. Furthermore, the antenna unit has an antenna base plate, in which a sound passage opening that opens into the sound channel of the coil core is formed. The antenna coil, the coil core and the antenna base plate in this case prescribe an antenna characteristic of the antenna unit. The side wall of the housing on the diaphragm side—i.e. the side wall opposite the loudspeaker diaphragm (surface)—is in this case formed by the antenna base plate.

This means that the loudspeaker module is an assembly that is formed from the loudspeaker and the antenna unit and that has the antenna unit integrated into the housing of the loudspeaker. A sound exit opening of the loudspeaker module, through which the sound produced by the loudspeaker diaphragm can be output into the surroundings, is in this case preferably formed by the free end of the sound channel that is remote from the antenna base plate (i.e. the sound exit opening is arranged at the free end of the coil core). In particular, the loudspeaker and the antenna unit, specifically the antenna base plate, have no additional housing parts arranged between them.

"Antenna characteristic" is understood here and subsequently to mean particularly performance features of the antenna unit, such as e.g. a (lowest possible expendable, electric) transmission power for the data transmission to a receiver, a high reception power and a low susceptibility to interference.

Since the sound channel is formed by the coil core on which the antenna coil is wound, installation space required for a separate antenna can be saved and hence the installation space that remains in the hearing device housing can be reduced without affecting the volume of the loudspeaker, particularly the back volume, or alternatively a loudspeaker having an appropriately enlarged back volume can be used in the design. Since the antenna base plate forms a side wall of the loudspeaker housing, it is advantageously possible, for a constant antenna volume, particularly for a constant length of the coil core, to reduce the front volume, formed largely by the sound channel, in proportion to the back volume. The antenna unit moves closer to the loudspeaker diaphragm. This advantageously lowers the acoustic resistance for the loudspeaker diaphragm and accordingly improves the sound characteristic of the loudspeaker. In this case, the invention is based on its own insight that reducing the front volume and enlarging the back volume increases the bandwidth and the efficiency of the loudspeaker at low frequencies. In addition, the loudspeaker can have a higher (sound output) power for constant or even decreased physical size (and particularly for constant electric power). Additionally, the integration of the antenna base plate into the housing of the loudspeaker module results in an altogether shortest possible physical length of the loudspeaker module (particularly along the coil axis of the antenna coil), which is advantageous for a compact design of the overall hearing device.

In a preferred embodiment, the loudspeaker diaphragm is mounted in the housing such that this isolates the sound channel from the housing interior. This means that the housing interior forms the back volume. The loudspeaker diaphragm seals the sound channel from the housing interior. The loudspeaker diaphragm is moved directly to the antenna base plate, except for a necessary oscillation distance. To this end, the loudspeaker diaphragm is mounted on the side walls of the housing, for example via a, in particular metal, edge region, or is installed directly on the antenna base plate. This firstly, in comparison with a standard loudspeaker design in which the loudspeaker diaphragm is stretched opposite the sound channel in a manner distinctly offset into the interior of the (usually parallelepipedal) housing and, in that case, divides the housing interior surrounding the (housing) side walls into two partial volumes, enlarges the back volume that the loudspeaker diaphragm isolates from the surroundings, in this case specifically the sound channel, particularly in relation to the front volume. The front volume is reduced to the volume that is present in the coil core anyway. An enlarged back volume likewise lowers the acoustic resistance for the loudspeaker diaphragm when the audible (output) signals are produced. In particular, an enlarged back volume improves the bass properties of the loudspeaker.

In a particularly expedient embodiment, the loudspeaker diaphragm is arranged in the coil core (i.e. inside the coil core). Preferably, the loudspeaker diaphragm is in this case arranged radially with respect to the coil axis of the antenna coil. In this embodiment, the back volume is enlarged further and the sound channel demarcated from the housing interior by the loudspeaker diaphragm, and hence the front volume arranged in the sound channel, are accordingly reduced further, so that the sound characteristic of the loudspeaker is improved further. In particular, the change of volume from the back volume and the front volume can advantageously present both high and low frequencies better (preferably with a clear sound).

In a further expedient embodiment, the diaphragm drive contains a drive coil having a coil axis. Preferably, the drive coil is elongated, in particular rectilinearly, along its coil axis, i.e. the drive coil has a greater length in comparison with its extent transversely with respect to the coil axis (also referred to as "thickness"). The coil axis of the antenna coil is in this embodiment preferably oriented perpendicularly to the coil axis of the drive coil. In this case, the antenna base plate is expediently also arranged perpendicularly to the coil axis of the antenna coil. Since the antenna coil and the drive coil (or the respective coil axes thereof) are oriented perpendicularly to one another, coupling of the magnetic field produced by this coil into the corresponding other coil is advantageously decreased during operation of the respective coil. In particular, this can advantageously reduce interfering induction of currents by the magnetic field of a coil in the corresponding other coil. Hence, particularly interference in the antenna by the magnetic field of the drive coil is decreased and hence the quality of the data transmission of the antenna unit is increased.

In a preferred development of the embodiment described above, the respective coil axes of the antenna coil and the drive coil are perpendicular to one another. In other words, the two coil axes intersect at an angle of 90°.

In a preferred embodiment, the coil core and the antenna base plate are produced from ferromagnetic and/or ferrimagnetic material. Preferably, the coil core and the antenna base plate are in this case formed from ferrite. The resultant magnetic properties mean that therefore both the coil core and the antenna base plate make a particularly advantageous contribution to the antenna characteristic of the antenna unit. In this embodiment, the antenna unit is preferably a magnetic antenna, particularly a "ferrite antenna". Such antennas are advantageously particularly well suited to signal transmission in a frequency range between preferably approximately 100 kHz and 10 MHz. The reason is that these antennas allow data transmission over comparatively short ranges, such as e.g. in the order of magnitude of the distance between the two ears of a human being, with simultaneously low (particularly in comparison with high-frequency data transmission systems) electric power draw. In particular, the magnetic fields used for data transmission in the case of these antennas are advantageously not or only negligibly attenuated in this comparatively low frequency range by the body tissue (particularly the head) arranged between the sending and receiving antennas. In addition, the magnetic antenna advantageously also has a smaller physical size in comparison with an antenna for an electric field, which in turn contributes to the saving of installation space. Furthermore, in this embodiment, the antenna base plate advantageously acts as a type of magnetic shield between the drive coil and the antenna coil. In particular, on account of its arrangement parallel to the coil axis of the drive coil—and hence its perpendicular orientation to the antenna coil—the antenna base plate shorts the magnetic field of the drive coil at least to a large extent transversely with respect to the coil axis of the antenna coil, so that coupling-in of the magnetic field of the drive coil and currents induced thereby in the antenna coil are negligibly low. Hence, the quality of the data transmission of the antenna unit (particularly the robustness thereof toward interfering magnetic fields) is increased further.

In a further expedient embodiment, the coil core of the antenna unit is arranged particularly such that the coil axis of the antenna coil intersects the drive coil. This further improves the shielding effect of the antenna base plate and hence further decreases the coupling of the magnetic field of the drive coil into the antenna coil.

In a preferred development, the coil core is arranged preferably such that the coil axis of the antenna coil runs substantially—i.e. exactly or approximately, particularly at a distance that is shorter by a multiple than the length of the drive coil—centrally to the drive coil. This achieves an arrangement, also referred to as "magnetically symmetrical", for the respective magnetic fields of the drive coil and the antenna coil that advantageously allows, particularly in combination with the ferromagnetic and/or ferrimagnetic antenna base plate, a particularly high shielding effect or negligibly low coupling of the magnetic field of the drive coil into the antenna coil.

In a further expedient embodiment, the antenna unit has at least one antenna side plate that extends at an angle to the antenna base plate, preferably perpendicular thereto, on a side of the antenna base plate that is remote from the antenna coil. Expediently, the or the respective antenna side plate covers a side wall (other than the diaphragm-side side wall described above) of the housing. Furthermore, the or the respective antenna side plate is preferably formed from the same material as the coil core and the antenna base plate. The antenna side plate in this case advantageously leads to an extension of the antenna unit (particularly along the coil axis of the antenna coil) and hence to a further improvement in the antenna characteristic. Furthermore, the magnetic field produced by the antenna coil is routed around the loudspeaker on account of the arrangement of the or of the respective antenna side plate. Furthermore, the or the respective antenna side plate also contributes to the shielding effect of the antenna base plate and hence to the shielding of the magnetic field produced by the drive coil from the antenna coil.

To provide further integration for the design of the loudspeaker module, an expedient development of the embodiment described above involves at least one of the further side walls of the housing that are described above being formed by the, or a respective, antenna side plate. This means that the side wall of the housing is dispensed with and is replaced by the antenna side plate. If the antenna unit contains particularly four of the antenna side plates described above, then they form a box-like or pot-like portion of the housing in the case of the present development.

In a further expedient embodiment, the antenna base plate is connected to the coil core and/or possibly to the or the respective antenna side plate at a distance, for example in the region of 50 to 150 μm, particularly approximately 100 μm. In other words, the antenna base plate, the coil core and possibly the or the respective antenna side plate are not directly in contact with one another, but rather are mounted at a distance from one another and relative to one another, for example by an adhesive layer and/or other kinds of insulating intermediate pieces—for example plastic. This advantageously achieves a high signal-to-noise ratio for the antenna unit, i.e. particularly interference-free reception. The magnetic field of the drive coil of the loudspeaker is shielded from the antenna with better attenuation.

The loudspeaker is, in a preferred embodiment, what is known as a "balanced armature" loudspeaker or a "moving armature" loudspeaker. In both cases, the loudspeaker, particularly the diaphragm drive thereof, contains, in addition to the drive coil, two permanent magnets and an armature that is arranged in a gap between the two permanent magnets and that is coupled to the loudspeaker diaphragm by means of a "drive rod". The armature moreover passes through the drive coil.

The hearing device according to the invention contains a loudspeaker module of the type described above, and also preferably a (hearing device) housing in which the loudspeaker module is arranged. Preferably, the loudspeaker module in this case has its sound channel positioned in a sound output opening of the hearing device housing.

Other features which are considered as characteristic for the invention are set forth in the appended claims.

Although the invention is illustrated and described herein as embodied in a loudspeaker module for a hearing device, and a hearing device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Parts and magnitudes that correspond to one another are provided with the same reference symbols throughout all the figures.

Figure 1:
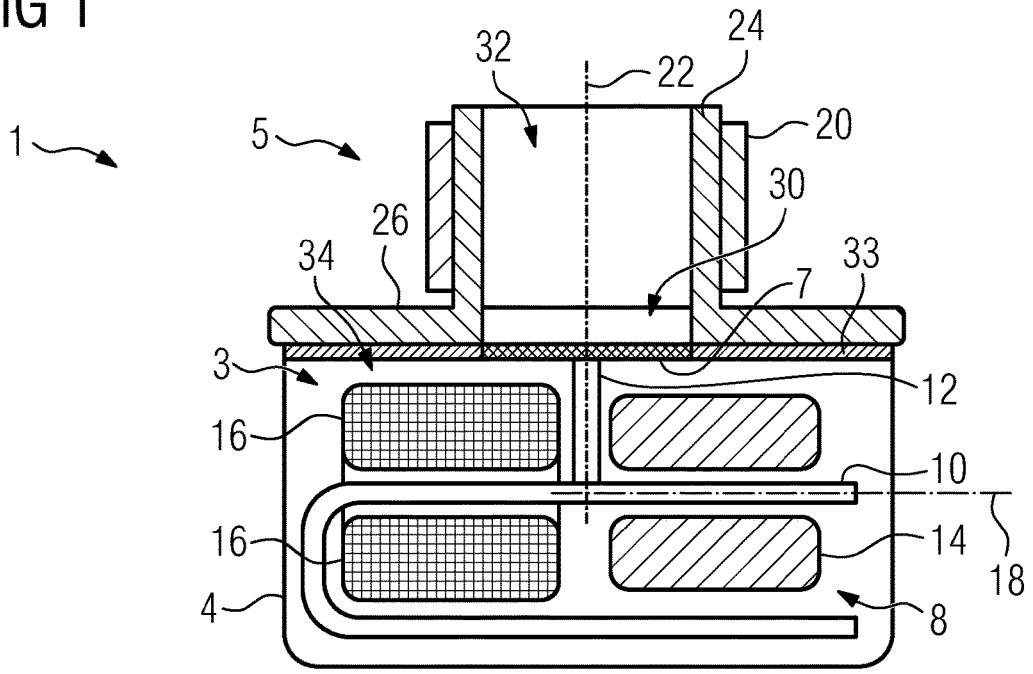
FIG. 1 is a diagrammatic, sectional view of a loudspeaker module for a hearing device according to the invention.
Figure 6:
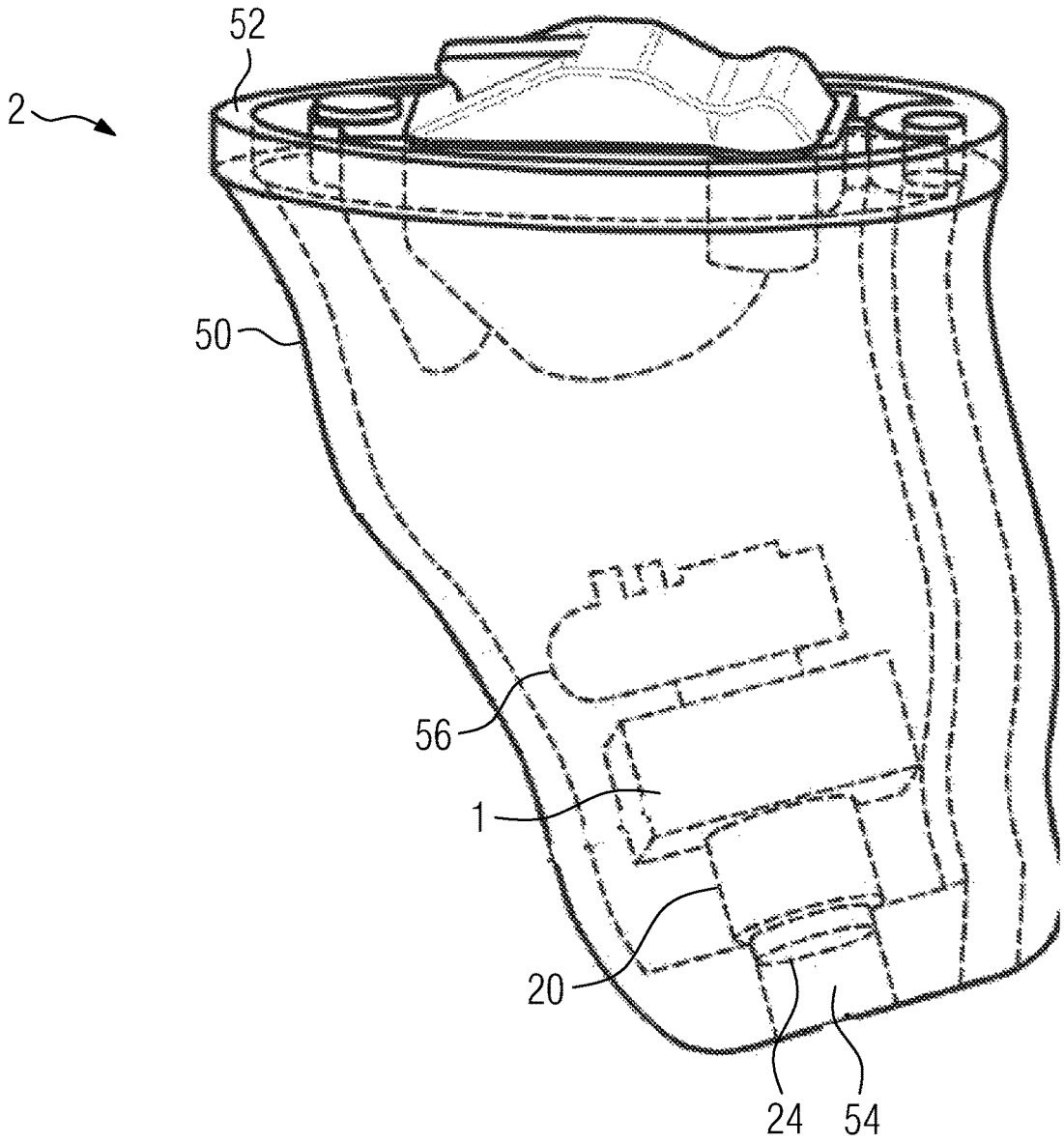
FIG. 6 is a transparent side view of the hearing device having the loudspeaker module according to one of the exemplary embodiments of FIGS. 1 to 5.

Referring now to the figures of the drawings in detail and first, particularly to FIG. 1 thereof, there is shown a loudspeaker module 1 for a hearing device 2 (depicted by way of example in FIG. 6). The loudspeaker module 1 contains a loudspeaker 3 that is arranged in a housing 4. Furthermore, the loudspeaker module 1 has an antenna unit 5 that is in the form of part of the housing 4. The loudspeaker module 1 therefore forms an integrated assembly for the hearing device 2 that is used for outputting audible signals and for sending and/or receiving electromagnetic (data) signals.

The loudspeaker 3 in the depicted exemplary embodiment is in the form of what is known as a "balanced-armature" loudspeaker. The loudspeaker 3 in this case has a loudspeaker diaphragm 7 that, during operation of the loudspeaker 3, is set in oscillation and thereby produces the audible signals. To produce the oscillation in the loudspeaker diaphragm 7, the loudspeaker 3 has a (diaphragm) drive 8. The diaphragm drive 8 has a substantially U-shaped armature 10 that is coupled to the loudspeaker diaphragm 7 by a drive rod 12. The diaphragm drive 8 additionally has two permanent magnets 14 that are arranged at a distance from one another and have a limb of the armature 10 running between them. Furthermore, the diaphragm drive 8 has a drive coil 16 by which, during operation of the loudspeaker 3, a magnetic field for alternatingly magnetizing the armature 10 is produced. The drive coil 16 is in this case produced in a manner elongated along a coil axis 18, i.e. with a longitudinal extent that is greater in comparison with the thickness thereof.

The antenna unit 5 has an antenna coil 20 that is arranged, specifically wound, along a (correspondingly associated) rectilinear coil axis 22. The antenna coil 20 is in this case wound on a hollow cylindrical, tubular (antenna) coil core 24 that is produced from ferromagnetic material, specifically ferrite. The coil axis 22 of the antenna coil 20 is in this case oriented perpendicular to the coil axis 18 of the drive coil 16. The antenna unit 5 furthermore contains an antenna base plate 26, likewise formed from ferromagnetic material, specifically ferrite, on which the coil body 24—and hence also the coil axis 22—stands perpendicularly. In the variant embodiment shown in FIG. 1, the coil core 24 and the antenna base plate 26 are manufactured in one piece, which results in simplified installation.

The antenna base plate 26 in this case forms a side wall, arranged on the diaphragm side of the loudspeaker 3, of the housing 4—in the depicted exemplary embodiment specifically a (top) cover plate of the housing 4. A sound passage opening 30 required for output of the audible signals produced by the loudspeaker diaphragm 7 is in this case formed directly in the antenna base plate 26. The sound passage opening 30 in this case opens into the cylinder interior of the coil core 24. This cylinder interior is subsequently referred to as a sound channel 32. The free end of the sound channel 32 remote from the antenna base plate 26 therefore forms a sound exit opening for the (entire) loudspeaker module 1.

An acoustically advantageous form is achieved in this case by virtue of the loudspeaker diaphragm 7 being arranged in the housing 4 directly at the lower end of the sound channel 32, and thereby isolating or sealing the sound channel 32 from the housing interior 34. In the present case, the loudspeaker diaphragm 7 is installed on the housing 4 via a, in particular metal, edge region 33. In an alternative configuration, the loudspeaker diaphragm 7 is mounted directly on the antenna base plate 26 via the edge region 33. The actual, freely oscillating diaphragm is situated directly below the sound channel 32. The housing interior 34, sealed from the sound channel 32 by the loudspeaker diaphragm 7, of the housing 4 therefore forms what is known as the back volume of the loudspeaker 3. The front volume, which is on the sound output side in relation to the loudspeaker diaphragm 7, is in this case formed essentially by the sound channel 32.

Figure 2:
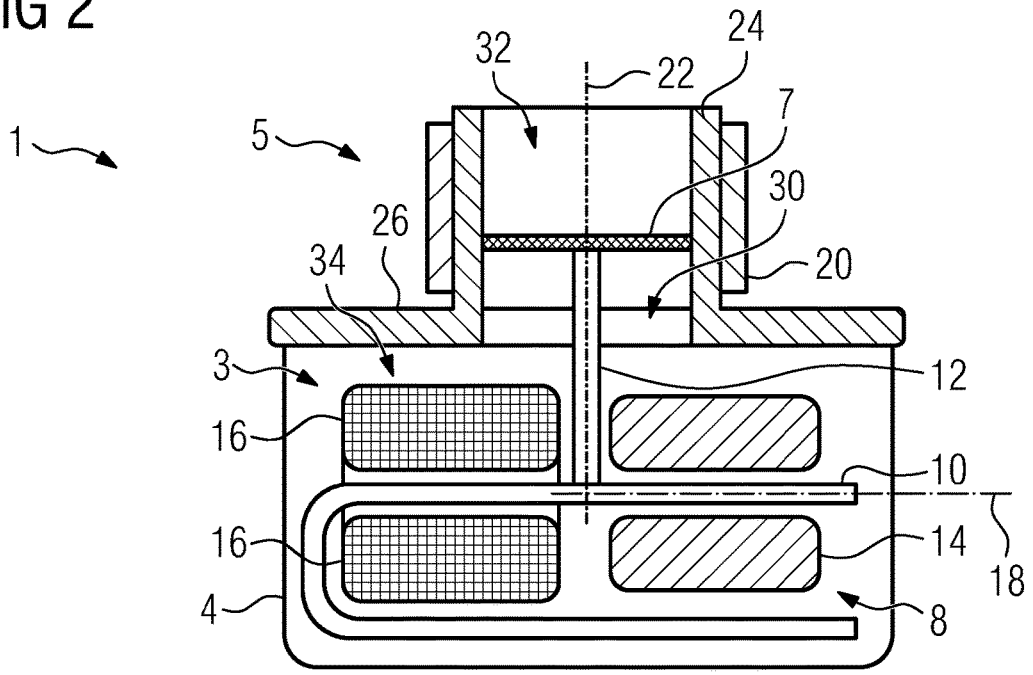
FIGS. 2 to 5 are sectional views each showing a further exemplary embodiment of the loudspeaker module in a view according to FIG. 1.

FIG. 2 depicts a further exemplary embodiment of the loudspeaker module 1. This exemplary embodiment differs from the exemplary embodiment depicted in FIG. 1 in that the loudspeaker diaphragm 7 is arranged and mounted inside the tubular coil body 24, specifically radially with respect to the coil axis 22. The drive rod 12 is in this case extended correspondingly. The arrangement of the loudspeaker diaphragm 7 in the coil body 24 results in an enlarged back volume and a reduced front volume in comparison with the exemplary embodiment according to FIG. 1—for otherwise constant dimensions of the loudspeaker module 1. This advantageously decreases the acoustic resistance counteracting the loudspeaker diaphragm 7, so that (even with the loudspeaker diaphragm 7 having a possibly reduced surface area) the sound characteristic of the loudspeaker 3 can be improved. As such, the loudspeaker module 1 configured in this manner can advantageously better transmit both low and high sounds—i.e. low and high frequencies.

Since the antenna base plate 26 is produced from ferromagnetic material, it serves firstly to improve the antenna characteristic of the antenna unit 5. Secondly, the antenna base plate 26 also shields the antenna coil 20 at least in part from the magnetic field emanating from the drive coil 16 during operation of the loudspeaker 3.

Figure 3:
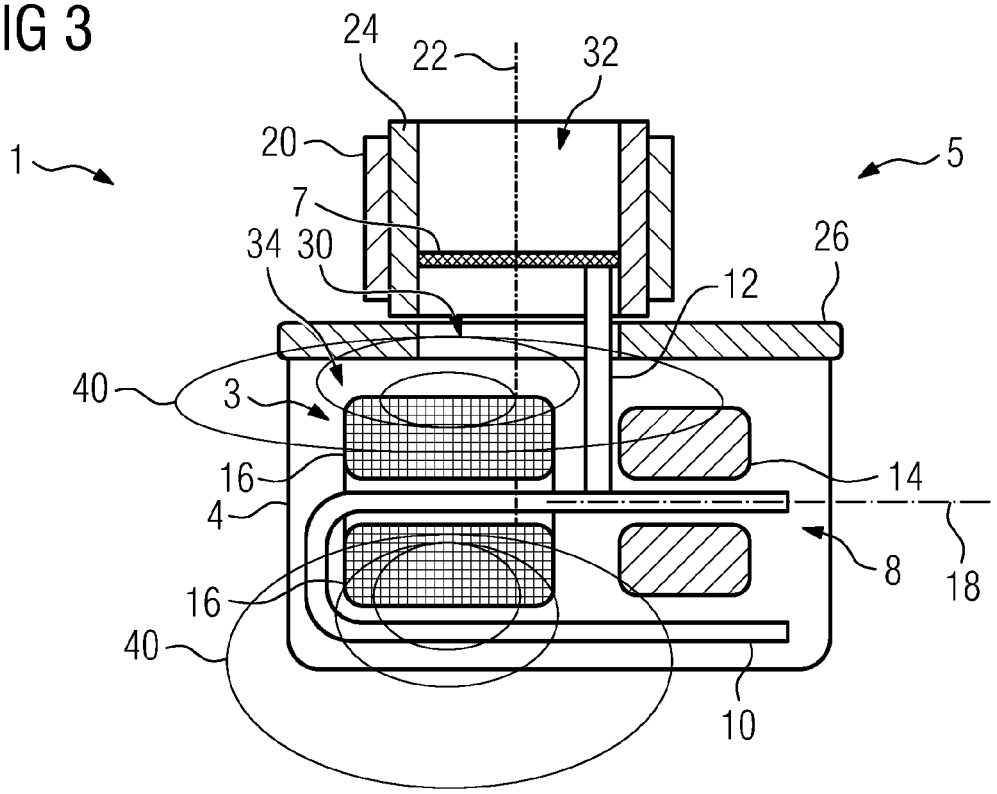

An exemplary embodiment of the loudspeaker module 1 that is improved in respect of the shielding effect of the antenna base plate 26 is depicted in FIG. 3. In this case, the coil core 24 and hence the antenna coil 20 are positioned on the antenna base plate 26 such that the coil axis 22 of the antenna coil 20 intersects the drive coil 16 of the loudspeaker 3. Specifically, in the exemplary embodiment depicted in FIG. 3, the coil axis 22 of the antenna coil 20 is oriented centrally to the drive coil 16 and, in addition, intersects the coil axis 18 of the drive coil 16 (in the middle of the drive coil 16). This results in a particularly favorable profile for the magnetic field of the drive coil 16 (depicted by schematically indicated magnetic field lines 40). The upper magnetic field lines 40 in FIG. 3 (i.e. the magnetic field lines 40 closer to the antenna coil 20) are in this case deflected by the antenna base plate 26 such that they are shorted approximately transversely (at right angles) with respect to the coil axis 22 of the antenna coil 20. This results in particularly low interfering influences by the magnetic field of the drive coil 16 on the antenna characteristic of the antenna unit 5. In addition, the coil core 24 is positioned at a short distance from the antenna base plate 26, for example by a foil. The magnetic field of the drive coil 16 is thereby additionally shielded from the antenna coil 20 with increased attenuation.

Figure 4:
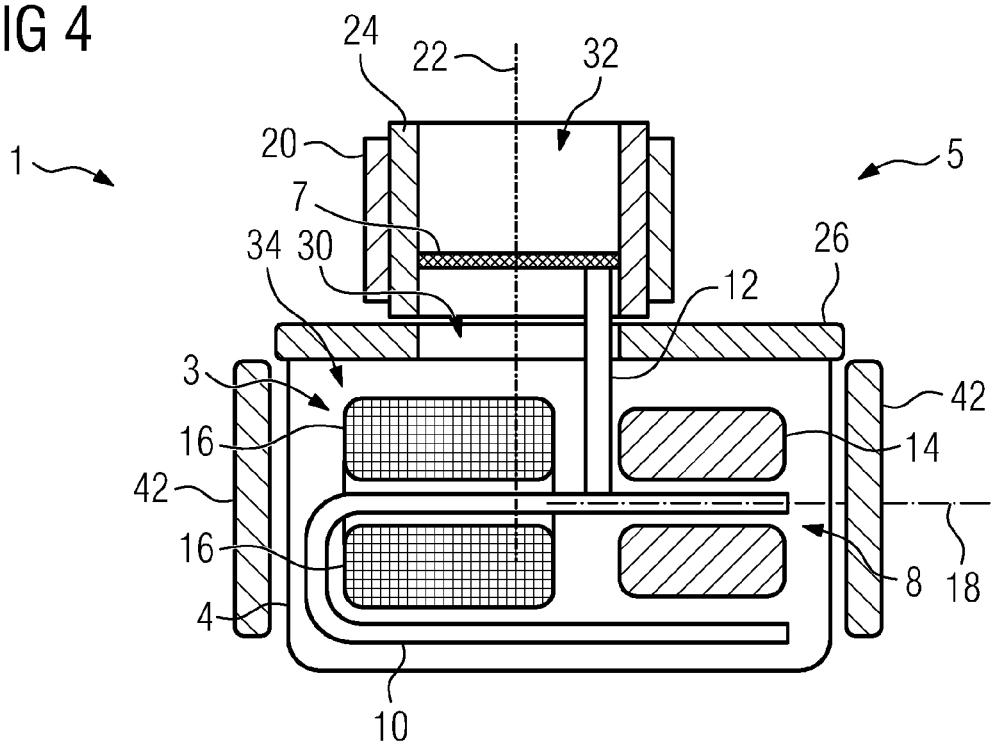
Figure 5:
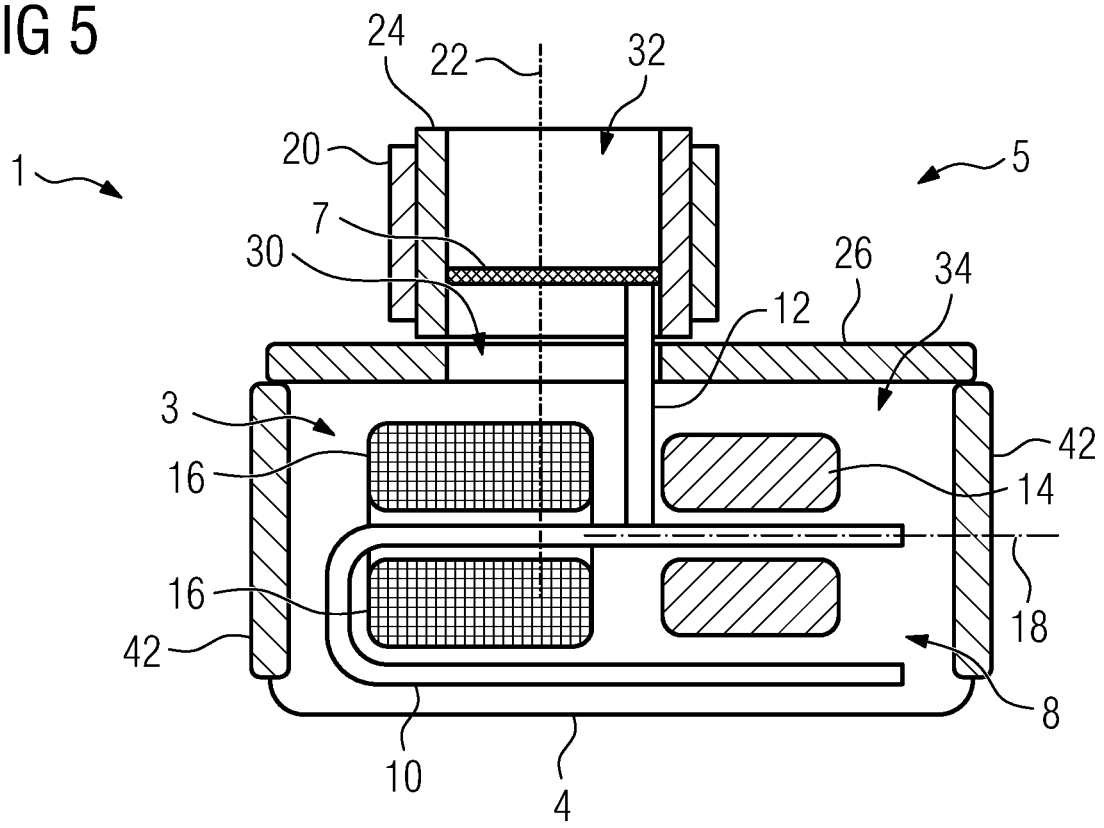

An improvement in the shielding effect of the antenna base plate 26 is obtained, however, even when the coil axis 22 of the antenna coil 20—as depicted in FIGS. 4 and 5—is not arranged centrally to the antenna coil 16, but rather is positioned such that it intersects the drive coil 16 (in a region between the middle thereof and one of the two ends). It is therefore advantageously possible to form a compromise between a decrease in the interfering influences on the antenna coil 20 by the drive coil 16 and the design restrictions (in most cases dependent on installation space) that are frequently obtained for hearing devices.

As is likewise depicted in FIG. 4, the antenna unit 5 additionally contains antenna side plates 42 that are arranged at an angle to the antenna base plate 26 on that side thereof that is remote from the antenna coil 20, and are specifically placed on the outside of the housing 4. These antenna side plates 42 advantageously route the antenna magnetic field produced by the antenna unit 20 around the loudspeaker 3 during operation of the antenna unit 5. Furthermore, the antenna side plates 42 also contribute to shielding the magnetic field of the drive coil 15 from the antenna coil 20.

As is furthermore evident from FIG. 4, the antenna side plates 42 and also the coil body 24 are each spaced at a short distance from the antenna base plate 26. The relevant distance is realized by an adhesive layer or by an interposed foil, for example.

In an exemplary embodiment that is not depicted in more detail, the antenna side plates 42 and the coil body 24 are, by contrast, in direct contact with the antenna base plate 26.

In a further exemplary embodiment, depicted in FIG. 5, the antenna side plates 42 are not placed on the housing 4, but rather form the respective side walls of the housing 4 itself that are perpendicular to the antenna base plate 26. This further reduces the volume taken up by the loudspeaker module 1 in comparison with the exemplary embodiment according to FIG. 4. In particular, the antenna side plates 42 and the antenna base plate 26 are manufactured as an integral unit in this case.

The hearing device 2 depicted in FIG. 6 is what is known as an in-the-ear hearing device (ITE hearing device for short). In this case, the hearing device 2 contains a hearing device housing 50 that is matched to the shape of the auditory canal of the hearing device wearer and that, at its end remote from the eardrum of the hearing device wearer in the intended wearing position, is sealed by a front plate (referred to as "face plate" 52). At its end facing the eardrum in the intended wearing position, the hearing device housing 50 has a sound output 54. On the inside of the housing, the loudspeaker module 1 with the coil body 24, forming the sound channel 32, of the antenna unit 5 is arranged in this sound output 54 in this case. Likewise depicted is an electronic unit 56 that is coupled by circuitry to the loudspeaker module 1 and carries the elements for signal processing.

The subject matter of the invention is not limited to the exemplary embodiments described above. Rather, further embodiments of the invention can be derived from the description above by a person skilled in the art. In particular, the individual features of the invention and of the variant configurations thereof that are described on the basis of the different exemplary embodiments can also be combined with one another in another way.

The following is a summary list of reference numerals and the corresponding structure used in the above description of the invention:

1 Loudspeaker module
2 Hearing device
3 Loudspeaker
4 Housing
5 Antenna unit
7 Loudspeaker diaphragm
8 Diaphragm drive
10 Armature
12 Drive rod
14 Permanent magnet
16 Drive coil
18 Coil axis
20 Antenna coil
22 Coil axis
24 Coil core
26 Antenna baseplate
30 Sound passage opening
32 Sound channel
33 Edge region
34 Housing interior
40 Magnetic field line
42 Antenna side plate
50 Hearing device housing
52 Face plate
54 Sound output
56 Electronic unit

The invention claimed is:

1. A loudspeaker module for a hearing device, comprising:

a loudspeaker having a loudspeaker diaphragm and a drive for said loudspeaker diaphragm;

a housing in which said loudspeaker is disposed and having a side wall;

an antenna unit having an antenna coil with a coil axis, a tubular coil core forming a sound channel, and an antenna base plate with a sound passage opening formed therein that opens into said sound channel, said antenna coil, said tubular coil core and said antenna base plate prescribe an antenna characteristic of said antenna unit, wherein said side wall of said housing on a diaphragm side is formed by said antenna base plate; and said loudspeaker diaphragm mounted in said housing such that said loudspeaker diaphragm isolates said sound channel from an housing interior of said housing.

2. The loudspeaker module according to claim 1, wherein:

said drive for said loudspeaker diaphragm contains a drive coil having a coil axis; and the coil axis of said antenna coil is oriented perpendicular to the coil axis of said drive coil.

3. The loudspeaker module according to claim 2, wherein said tubular coil core is disposed such that said coil axis of said antenna coil intersects said drive coil.

4. The loudspeaker module according to claim 2, wherein said tubular coil core is disposed such that said coil axis of said antenna coil runs substantially centrally to said drive coil.

5. The loudspeaker module according to claim 1, wherein said tubular coil core and said antenna base plate are produced from at least one of a ferromagnetic material or a ferrimagnetic material.

6. The loudspeaker module according to claim 1, wherein said antenna unit has at least one antenna side plate that extends at an angle to said antenna base plate on a side of said antenna base plate that is remote from said antenna coil.

7. The loudspeaker module according to claim 6, wherein said housing has a further side wall formed by said antenna side plate.

8. A loudspeaker module for a hearing device, comprising:

a loudspeaker having a loudspeaker diaphragm and a drive for said loudspeaker diaphragm;

a housing in which said loudspeaker is disposed and having a side wall;

an antenna unit having an antenna coil with a coil axis, a tubular coil core forming a sound channel, and an antenna base plate with a sound passage opening formed therein that opens into said sound channel, said antenna coil, said tubular coil core and said antenna base plate prescribe an antenna characteristic of said antenna unit, wherein said side wall of said housing on a diaphragm side is formed by said antenna base plate; and said loudspeaker diaphragm is disposed in said tubular coil core.

9. A hearing device, comprising:

a loudspeaker module, containing:

a loudspeaker having a loudspeaker diaphragm and a drive for said loudspeaker diaphragm;

a housing in which said loudspeaker is disposed and having a side wall;

an antenna unit having an antenna coil with a coil axis, a tubular coil core forming a sound channel, and an antenna base plate with a sound passage opening formed therein that opens into said sound channel, said antenna coil, said tubular coil core and said antenna base plate prescribe an antenna characteristic of said antenna unit, wherein said side wall of said housing on a diaphragm side is formed by said antenna base plate; and said loudspeaker diaphragm mounted in said housing such that said loudspeaker diaphragm isolates said sound channel from an housing interior of said housing.

* * * * *